US005629987A

United States Patent [19]

Hobelsberger

[11] Patent Number: 5,629,987

[45] **Date of Patent: *May 13, 1997**

[54] LOUDSPEAKER SYSTEM WITH CLOSED HOUSING FOR IMPROVED BASS REPRODUCTION

[76] Inventor: Maximilian H. Hobelsberger, Dorfstr. 16, CH-5303 Würenlingen, Switzerland

[ * ] Notice: The term of this patent shall not extend beyond the expiration date of Pat. No. 5,327,504.

[21] Appl. No.: 364,738

[22] Filed: Dec. 27, 1994

Related U.S. Application Data

[63] Continuation of Ser. No. 15,855, Feb. 10, 1993, abandoned.

[30] Foreign Application Priority Data

Feb. 15, 1992 [CH] Switzerland ..... 438/92

[51] Int. Cl.[6] ..... H04R 25/00

[52] U.S. Cl. ..... 381/96; 381/159; 381/190

[58] Field of Search ..... 381/96, 190, 173, 381/191, 88, 90, 89, 159, 192; 310/324

[56] References Cited

U.S. PATENT DOCUMENTS

| | | | |
|---|---|---|---|
| 2,948,778 | 8/1960 | Clements | 381/96 |
| 3,366,748 | 1/1968 | Ashworth | 381/190 |
| 5,327,504 | 7/1994 | Hobelsberger | 381/159 |

FOREIGN PATENT DOCUMENTS

| | | | |
|---|---|---|---|
| 0466417 | 7/1975 | U.S.S.R. | 310/324 |
| 2157914 | 10/1985 | United Kingdom | 381/96 |

*Primary Examiner*—Curtis Kuntz
*Assistant Examiner*—Huyen D. Le

[57] ABSTRACT

Loudspeaker system with closed housing for improved bass reproduction. The loudspeaker system operates utilizing pressure control in the closed loudspeaker housing. This pressure control suppresses pressure changes of the air inside the housing. The control circuit comprises a pressure sensor, a controller, a power amplifier and an electrodynamic transducer inside the housing. The membrane of the transducer is covered with piezoelectric material and conducting coatings forming piezoelectric sensors to measure the changes of the air pressure upon the surface. The piezoelectric material consists of polyvinylidene fluoride, PVDF. The sensors are specially shaped to avoid distortions. They differ in thickness for the elimination of acceleration-dependent signal terms.

6 Claims, 2 Drawing Sheets

LOUDSPEAKER SYSTEM WITH CLOSED HOUSING FOR IMPROVED BASS REPRODUCTION

CROSS-REFERENCE TO RELATED APPLICATIONS

This application is a continuation of my earlier application, Ser. No. 08/015,855 filed Feb. 10, 1993, now abandoned. Foreign priority was claimed of the Swiss patent application No. 438/92-7 of Feb. 15, 1992.

BACKGROUND OF THE INVENTION

1. Field of the Invention

This invention relates to sound reproduction systems with electrodynamic loudspeakers and closed housings. More particularly, the invention relates to a sound reproduction system for improved bass reproduction.

2. Prior Art

Conventional loudspeaker systems have an inferior bass reproduction if the housings are small. In small housings air compression forces will build up and hinder the movement of the radiating loudspeaker's membrane. These forces evolve from volume changes in the air inside the housing which are caused by the movement of the loudspeaker's membrane. The membrane compresses or decompresses the air and the resulting forces hinder the movement of the membrane. Being elastic forces they also increase the resonance frequency of the system. To achieve a satisfying bass reproduction large, impractical housings are used, or different kinds of resonant boxes are employed. Often the driving signals are corrected in their frequency characteristic, or the loudspeakers are controlled by servo systems. All these solutions cause distortions or are impractical to use, or show a poor pulse response.

Another known method (Tiefenbrun, U.S. Pat. No. 4,008,374) uses a second loudspeaker incorporated into the housing to simulate a larger volume. However this method just transfers the problems from the outer to the inner loudspeaker. To achieve satisfying results large housings must be used once again. Additionally, problems arise from distortions caused by phase differences between the movements of the membranes.

Price Shelton's invention (Goodman, appl. GB.821 5906) follows Tiefenbrun's principle of using an inner transducer to simulate a larger inner volume. In addition Shelton places a pressure sensor into the inner chamber of the housing to measure pressure changes. The signal produced by the sensor is amplified by an operational amplifier and drives the inner transducer. Optionally a feedback circuit can be inserted into the signal path between the sensor and the amplifier.

Sheltons disclosure fails to teach how the system should really work: In particular just conveying the signal produced by the sensor to the operational amplifier will result in oscillation of the system and distortions generated by the system. The function of the optional feedback circuit is not clearly defined either.

Max Hobelsberger's invention (U.S. appl. No. 07/776,426) functions according to the same principles, a transducer and a pressure sensor are placed inside the housing. Additionally M. Hobelsberger uses the principle of servo control to control the air pressure inside the housing: A controller, together with a closed loop control system, keeps the pressure inside the housing equal to the mean air pressure outside the housing.

However his disclosure does not teach where to arrange the pressure sensor in relation to the rest of the system. This placement of the sensor proves to be crucial to the functioning of the system: A wrong placement of the sensor will cause oscillations and distortions.

SUMMARY OF THE INVENTION

It is an object of this invention to provide a novel loudspeaker system with pressure controlled inner volume. This system provides a superior performance concerning distortions and oscillations, and it will be easy to manufacture.

The invented system follows the function principle, that changes of the air pressure inside the housing are almost eliminated by the use of a closed loop control system. The pressure changes are measured by pressure sensors and the corresponding electrical signals are conveyed to a controller. The control system practically eliminates the pressure changes. This reduction of pressure changes is achieved by the movement of the membrane of an electromechanical transducer inside the housing. The membrane adjoins the concerned air volume inside the housing. The membrane of the transducer is driven by e.g. a voice coil. The transducer is incorporated into a closed loop control system. A controller receives the electrical signals produced by the pressure sensors. It calculates corresponding output signals, which are amplified by a power amplifier and which then drive the transducer. The signals are calculated in a way that the membrane of the transducer is forced to perform movements which eliminate the pressure changes. One main characteristic of the invention is that the pressure sensor is placed directly upon the membrane of the inner transducer.

For a fuller understanding of the nature of the invention, reference should be made to the following detailed description of the preferred embodiments of the invention, considered together with the accompanying drawings.

DESCRIPTION OF THE PREFERRED EMBODIMENTS

Figure 1:
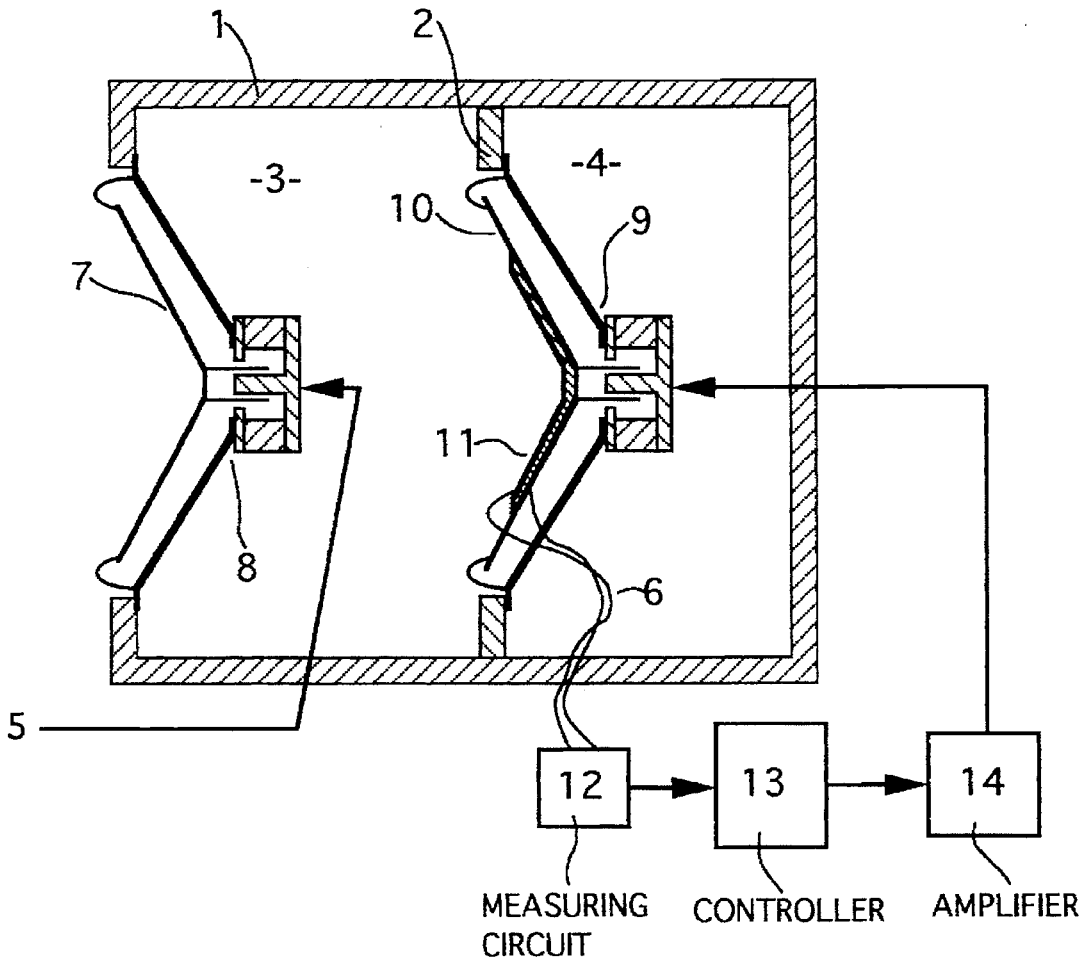
FIG. 1 is a schematic view of a speaker system that is a preferred embodiment of the present invention.

The following is a description of a first embodiment of the invention and refers to FIG. 1.

A loudspeaker 8 is built into an opening of the soundproof and pressure-tight housing 1 with its membrane 7 front facing outward. The loudspeaker 8 is directly driven by the audio signal 5. The loudspeaker housing 1 is divided into two chambers, 3, 4, by a soundproof and almost pressure-tight wall 2. The first chamber, 3, is enclosed by the membrane 7 of the sound radiating loudspeaker 8, by the walls of the housing and by the inner wall 2. The other chamber, 4, is enclosed by the inner wall 2 and the walls of the housing 1. An electrodynamic transducer 9 is built into an opening of the inner wall 2 so that its membrane 10 separates the chamber 3 from the chamber 4.

A piezoelectric pressure sensor 11 is placed into the first chamber 3 which adjoins the membrane 7 of the sound radiating loudspeaker 8. The sensor is attached directly to the transducer membrane's 10 surface adjoining the chamber 3. The sensor is coupled to a measuring circuit 12 via the wire 6. This circuit produces an electrical signal indicative of pressure changes in this chamber. The pressure changes are caused by the movements of the membrane 7 of the loudspeaker.

The output signal of the measuring circuit 12 is conveyed to the input of a servo controller 13.

This controller 13 is one element of a closed loop control system. The other elements are the electrodynamic transducer 9, the power amplifier 14 and the pressure sensor 11 with the circuit 12. The output of the controller 13 is connected to a power amplifier 14, which amplifies the signal and drives the transducer 9. The controller generates output signals to minimize the signal indicative of pressure changes and therefore also eliminates the pressure changes. This is achieved by appropriate movement of the membrane 10 of the transducer 9.

By attaching the pressure sensor directly upon the membrane's surface several advantages are provided. First of all the path from the actuator, i.e. the membrane 10 of the transducer 9, to the sensor 11 is very short. Thus no distortions and oscillations caused by dead times and signal delay will be generated. Secondly the sensor is decoupled effectively from vibrations of the housing and can react only to the pressure changes. Thirdly, the inertia of the sensor's material provides a kind of "lead-compensation" of the control loop which enhances its stability.

Figure 2:
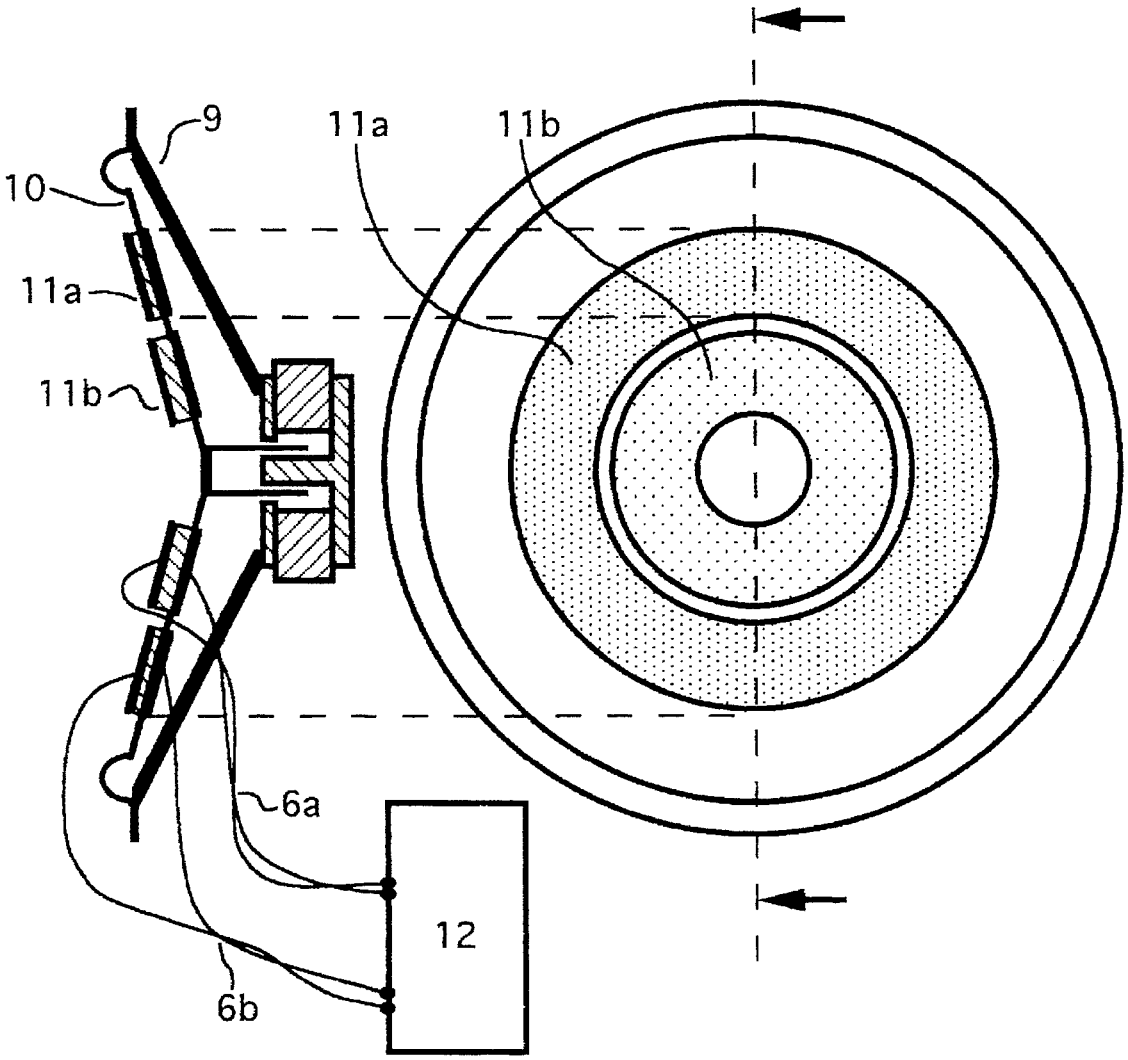
FIG. 2 shows a preferred arrangement of the pressure sensor on the transducer's membrane.

FIG. 2 shows a preferred pressure sensor which is directly attached to the membrane 10 of the transducer 9. The pressure sensor is arranged in the shape of two concentric rings 11*a*, 11*b*, which consist of layers of piezoelectric material, covered with layers of conducting metalization. The two rings 11*a*, 11*b* are connected by wires 6*a*, 6*b* to the measuring circuit 12. In the following some more details are given about the preferred pressure sensors.

In the invented device a thin, flexible coating of piezoelectric material is applied directly to the surface of the membrane, forming an integral part of the membrane. The coating is thin and shaped specifically to avoid the generation of disturbing signals caused by bending and tension of the membrane. To accomplish this the layer of piezoelectric material is arranged for instance in the form of concentric rings on the membrane's surface. These concentric rings are separated from each other by thin slits of uncovered areas. Another arrangement would be in the shape of small hexagons of piezoelectric material separated by thin slits. Because of the slits and because of the flexibility of the layer the driving forces exercised by the voice coil upon the membrane are transferred via the membrane itself and not via the piezoelectric layer.

Very advantageous is the usage of piezoelectric polymers for the pressure sensor. Especially the material polyvinylidene fluoride, PVDF, is well-suited for this purpose.

To eliminate the distortions of the generated signal caused by resonant waves in the membrane itself, substantial parts of the membrane's surface are covered with the piezoelectric material.

The sensor in FIG. 2 is constructed to avoid the generation of signals which are proportional to the acceleration of the piezoelectric material rather than to the pressure upon the surface. For this the piezoelectric layer consists of several areas which differ in their thickness from each other. Each area is equipped with its own electrodes to form independent sensors. The signals generated by the different areas are processed by an electronic circuit. By appropriate multiplication, addition and subtraction of the signals the terms which are acceleration-dependent will eliminate each other. The resulting signal will be mainly proportional to the pressure. If there are two areas with the same size, but the thickness of the one layer is twice the thickness of the other layer, the signal of the thinner sensor must be multiplied by two and the signal of the thicker sensor must be subtracted from the result of the multiplication.

Figure 3:
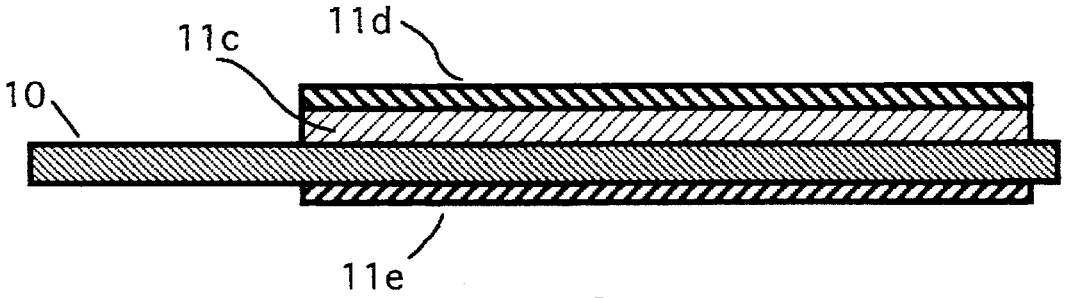
FIG. 3 shows an enlarged section of the transducer's membrane, covered with the pressure sensor.

FIG. 3 shows a simple way to arrange the electrodes 11*d*, 11*e* of the pressure sensor. They are applied on the two opposite surfaces of the membrane 10 after it has been coated with the piezoelectric material 11*c*. Thus the membrane and the piezoelectric layer lie in between the two electrodes. The metalization can be applied by metal vapor deposition.

While the present invention has been described in connection with particular embodiments thereof, it will be understood by those skilled in the art that many changes and modifications may be made without departing from the true spirit and scope of the present invention. Therefore, it is intended by the appended claims to cover all such changes and modifications which come within the true spirit and scope of this invention.

What is claimed is:

1. A loudspeaker system with closed housing for improved bass reproduction, comprising:

an acoustically closed housing;

a loudspeaker being so mounted in the housing that said loudspeaker's membrane's front faces outward of the housing;

a soundproof and pressure-tight wall dividing the inner volume of said acoustically closed housing into two chambers, whereby the first of said chambers is enclosed by the membrane of said loudspeaker, said inner wall and the walls of said housing, and the second of said chambers is enclosed by said inner wall and the walls of said housing;

a closed loop automatic control system, comprising:

an electrodynamic transducer, being built into an opening of said inner wall and separating with said transducer's membrane said first and said second chamber;

a pressure sensor, being placed in said first inner chamber which adjoins the membrane of said loudspeaker, whereby said pressure sensor is attached to the surface of said transducer's membrane, for measuring the air pressure changes in this chamber and producing an electrical signal which is proportional to these pressure changes;

a measuring circuit, to the input of which the output of said sensor is applied;

a power amplifier, the output of said amplifier being connected to said electrodynamic transducer to drive said transducer;

an electrical controller, to the input of which the signal produced by said measuring circuit is applied, the output of said controller being connected to the input of said power amplifier to drive the amplifier, and said controller being dimensioned to hold constant the pressure in said first inner chamber by causing said electrodynamic transducer's membrane to move.

2. Loudspeaker system of claim 1, whereby parts of one or both surfaces of the membrane of said transducer are covered with layers of piezoelectric material, whereby the outer surfaces of these piezoelectric layers and their inner surfaces, adjoining to the membrane, are coated with layers of electrically conducting material to act as electrodes, whereby the piezoelectric material lies between the electrodes and pressure changes upon the piezoelectric layers generate electrical voltages between the electrodes, and whereby the piezoelectric and conductive layers are made thin and flexible or are shaped by slits, that the driving forces of a voice coil upon the membrane are transmitted across the membrane via the membrane itself and not via the piezoelectric layer.

3. Loudspeaker system of claim 2, whereby said piezoelectric layers consist of the material polyvinylidene fluoride or other piezoelectric polymers.

4. Loudspeaker system of claim 2, whereby one or both surfaces of the membrane of said transducer are almost completely covered by said piezoelectric layers.

5. Loudspeaker system of claim 2, whereby the piezoelectric layers of the transducer are arranged as several individual segments, which differ from each other in thickness and area, whereby each segment is equipped with individual conducting electrodes to form individual piezoelectric elements, and whereby the voltages generated by the piezoelectric elements are multiplied, added and subtracted by said measuring circuit, that those parts of the signals, which are caused by the inertia of the piezoelectric elements and which are proportional to the acceleration, eliminate each other.

6. Loudspeaker system of claim 2, whereby the one electrode of said pressure sensor covers the surface of the piezoelectric layer, the other electrode covers the membrane's surface opposite of the piezoelectric layer, and the membrane and the piezoelectric layer lie both in between the two electrodes.

* * * * *